US005642707A

United States Patent [19]

Cerf et al.

[11] Patent Number: 5,642,707

[45] Date of Patent: Jul. 1, 1997

[54] METHOD AND DEVICE FOR CONTROLLING THE IDLING SPEED OF AN INTERNAL COMBUSTION ENGINE

[75] Inventors: Patrice Cerf, Tournefeuille; Jean-Michel Le Quellec, Toulouse; Bernard Demaya, Valence d'Agen, all of France

[73] Assignee: Siemens Automotive S.A., Toulouse Cedex, France

[21] Appl. No.: 581,603

[22] PCT Filed: Jul. 1, 1994

[86] PCT No.: PCT/EP95/02155

§ 371 Date: Apr. 1, 1996

§ 102(e) Date: Apr. 1, 1996

[87] PCT Pub. No.: WO95/02121

PCT Pub. Date: Jan. 19, 1995

[30] Foreign Application Priority Data

Jul. 6, 1993 [FR] France ..... 93 08275

[51] Int. Cl.[6] ..... F02M 3/00

[52] U.S. Cl. ..... 123/339.23

[58] Field of Search ..... 123/339.23, 339.22, 123/339.17, 325, 353, 352; 364/431.07, 424.01, 431.05

[56] References Cited

U.S. PATENT DOCUMENTS

| | | | |
|---|---|---|---|
| 5,035,217 | 7/1991 | Kako | 123/339.23 |
| 5,153,446 | 10/1992 | Shimomura | 123/339.23 |
| 5,228,421 | 7/1993 | Orzel | 123/339.23 |
| 5,313,395 | 5/1994 | Kawai et al. | 123/339.23 |
| 5,365,903 | 11/1994 | Watanabe | 123/339.22 |
| 5,415,143 | 5/1995 | Togai | 123/339.17 |
| 5,421,302 | 6/1995 | Livshits et al. | 123/339.23 |
| 5,507,262 | 4/1996 | Isobe et al. | 123/339.23 |

FOREIGN PATENT DOCUMENTS

| | | | |
|---|---|---|---|
| 0176323 | 4/1986 | European Pat. Off. | 123/339.23 |
| 0423351 | 4/1991 | European Pat. Off. | 123/339.23 |
| 0486694 | 5/1992 | European Pat. Off. | 123/339.23 |
| 2162973 | 2/1986 | United Kingdom | 123/339.23 |
| 2168830 | 6/1986 | United Kingdom | 123/339.23 |

*Primary Examiner*—Raymond A. Nelli

*Attorney, Agent, or Firm*—Herbert L. Lerner; Laurence A. Greenberg

[57] ABSTRACT

The device operates by correcting the opening of an additional air control valve (13) as a function of the error $E=N_c-N$ between a set-point speed ($N_c$) and the actual speed (N), and of the time derivative (E') of this error. The correction is a function of the deviation between the actual state of the engine (E, E') and the locus of the ideal states of the engine, defined by the pairs of specific values (E, E') which correspond to the states of the engine which allow the set-point speed ($N_c$) to be regained without correcting the nominal opening of the valve (13). The device includes means (16, 17, 18) for outputting signals representing the error and its derivative to controllers (19, 19') whose outputs ($\Delta u_1$, $\Delta u_2$) are combined linearly by means (20, 20', 24) which output a signal ($\Delta u$) for correcting the nominal control of the opening of the valve (13), as a function of the aforementioned deviation.

15 Claims, 5 Drawing Sheets

FIG. 4

| E' \ E | NTG | NG | NM | NP | ZE | PP | PM |
|---|---|---|---|---|---|---|---|
| PTG | ZE | PP | PM | PG | PTG | PTG | PTG |
| PG | NP | ZE | PP | PM | PG | PTG | PTG |
| PM | NM | NP | ZE | PP | PM | PG | PTG |
| PP | NG | NM | NP | ZE | PP | PM | PG |
| ZE | NTG | NG | NM | NP | ZE | PP | PM |
| NP | NTG | NTG | NG | NM | NP | ZE | PP |
| NM | NTG | NTG | NTG | NG | NM | NP | ZE |

FIG. 5

| E' | PTG | PG | PM | PP | ZE | NP | NM |
|---|---|---|---|---|---|---|---|
| | PTG | PG | PM | PP | ZE | NP | NM |

FIG. 6

| E' \ E | NTG | NG | NM | NP | ZE | PP | PM |
|---|---|---|---|---|---|---|---|
| PTG | PTG | | | | | | PTG |
| PG | PM | | | | | | |
| PM | ZE | | | | PTG | | |
| PP | NM | | | | PM | | |
| ZE | NTG | | | | ZE | | |
| NP | | | | | NM | | |
| NM | NTG | | | | NTG | | |

FIG. 7

| E' \ E | NTG | NG | NM | NP | ZE | PP | PM |
|---|---|---|---|---|---|---|---|
| PTG | | | | | | | |
| PG | PTG | | | | | | |
| PM | PM | | | | PTG | | |
| PP | ZE | | | | PM | | |
| ZE | NM | | | | ZE | | |
| NP | NTG | | | | NM | | |
| NM | | | | | NTG | | |

| E' \ E | NTG | NG | NM | NP | ZE | PP | PM |
|---|---|---|---|---|---|---|---|
| PTG | PTG | PTG | PTG | PTG | PTG | PTG | PTG |
| PG | PM | PG | PTG | PTG | PTG | PTG | PTG |
| PM | ZE | PP | PM | PG | PTG | PTG | PTG |
| PP | NM | NP | ZE | PP | PM | PG | PTG |
| ZE | NTG | NG | NM | NP | ZE | PP | PM |
| NP | NTG | NTG | NTG | NG | NM | NP | ZE |
| NM | NTG | NTG | NTG | NTG | NTG | NG | NM |

| E' \ E | NTG | NG | NM | NP | ZE | PP | PM |
|---|---|---|---|---|---|---|---|
| PTG | PG | | | PTG | | | PTG |
| PG | PM | | | | PG | | |
| PM | PP | | | PM | | | |
| PP | ZE | | | PP | | | PM |
| ZE | | NP | | | ZE | | PP |
| NP | NG | | NM | | NP | | |
| NM | NTG | | | NG | | NM | |

| E' \ E | NTG | NG | NM | NP | ZE | PP | PM |
|---|---|---|---|---|---|---|---|
| PTG | PTG | PTG | PTG | PTG | PTG | PTG | PTG |
| PG | PM | PG | PTG | PTG | PTG | PTG | PTG |
| PM | ZE | PP | PM | PG | PTG | PTG | PTG |
| PP | NM | NP | ZE | PP | PM | PG | PTG |
| ZE | NTG | NG | NM | NP | ZE | PP | PM |
| NP | NTG | NTG | NTG | NG | NM | NP | ZE |
| NM | NTG | NTG | NTG | NTG | NTG | NG | NM |

METHOD AND DEVICE FOR CONTROLLING THE IDLING SPEED OF AN INTERNAL COMBUSTION ENGINE

This application is a 371 of PCT/EP95/02155.

BACKGROUND OF THE INVENTION

Field of the Invention

The present invention relates to a process and a device for controlling the speed of an internal combustion engine during a deceleration phase, and more specifically to a process and a device of this type which work by correcting the control of an actuator which affects this speed as a function of the deviation between a set-point speed and the actual speed.

Internal combustion engines, particularly those which drive automobiles, run at variable speeds, the control and/or adjustment of which is often tricky, particularly during the deceleration phase. A deceleration phase usually begins when the driver lifts his foot off the accelerator. The purpose of speed control during such a phase is to ensure the return of this speed to a set-point speed, the adjustment of the speed to around this set-point speed in spite of potential disturbances, and the passage through various transitory phases such as a "driven" deceleration phase in which the vehicle runs with an engaged gear box ratio, or a startup phase of the engine.

In each of these circumstances, control of the speed is quite tricky, since it is known that the stability of an engine is difficult to ensure at low speed and that the performance of the engine is difficult to model. Moreover, the conditions for the onset of a deceleration phase can vary considerably, for example in terms of the driver's action on the accelerator pedal, the temperature of the engine coolant, the air temperature, and the potential presence of random disturbances due to the engagement of an electrical device (lighting device, ventilator) or mechanical device (air conditioner, power steering). The speed control must also take into account other constraints associated with the driver's comfort (noise level, vibrations, jerking) and to standards related to the pollution of the environment by the exhaust gases from the engine.

At present, in order to ensure the control of the speed of an engine during deceleration, closed loop control devices with "supervised" PID-type controllers are commonly used. A device of this type is described in German patent disclosure DE-A-4 215 959, for example, which uses fuzzy logic to adjust the P, I and D terms of the controller. The result is a time-consuming, tedious tuning of the controller to adapt it to each type of engine. The PID adjustment is also disadvantageous in that it only takes into account certain aspects of the operation of the engine, and in that it is not entirely satisfactory from the point of view of "robustness", since the aging of the engine or the manufacturing tolerances for engines can unfavorably affect the operation of a "supervised" PID controller.

Another process for controlling the deceleration speed of an internal combustion engine, which is based entirely on experimental results formalized with the aid of fuzzy logic and is therefore likely, a priori, to have greater robustness and flexibility, is known from document No. 900594 published by the Society of Automotive Engineers of the United States of America. However, the process described requires the utilization of tables and complex operators which take up a lot of space in the memory of the computer used to implement the process, which also means long calculation times.

The object of the present invention is to provide a process for controlling the speed of an internal combustion engine during deceleration which will be satisfactory from four points of view: robustness, resistance to disturbances, ease of adjustment and the pleasure of driving a vehicle propelled by such an engine, in all the phases of deceleration.

Another object of the present invention is to produce a device for implementing this process.

These objects of the invention, as well as others which will become apparent through a reading of the description which follows, are achieved by means of a process for controlling the deceleration speed N of an internal combustion engine by correcting the control of an actuator which affects this speed as a function of the error $E=N_c-N$ between a set-point speed $N_c$ and the actual speed N; this process is remarkable in that it establishes the locus of the ideal states of the engine, defined by the pairs of specific values of the error E and its time derivative E' which correspond to the states of the engine which allow the set-point speed $N_c$ to be regained without correcting the control of the actuator, by means of a monotonic, rapid and smooth variation of the speed N, and in that it corrects the control of the actuator as a function of the deviation between the actual state (E, E') of the engine and the locus of the ideal states of this engine.

As will be seen below, control of the deceleration speed of the engine is optimized and simplified by the establishment of the locus of the "ideal" states of the engine according to the invention.

In another characteristic of the process according to the invention, a correction value $\Delta u$ for the control of the actuator is drawn from a table with two inputs constituted by the error E and the derivative E' of the error, respectively. The table contains specific values for the correction $\Delta u$ of the control of the actuator, each of which is associated with a pair of specific values of the error E and the derivative E' of the error.

In an advantageous variant of the process according to the invention, the correction $\Delta u$ of the control of the actuator is drawn from a linear combination of partial corrections taken from this table and from a second table, respectively, which second table corresponds specific values of the partial correction it determines with specific values of the derivative E' of the error. Thus, it is possible to adapt the control of the deceleration speed of the engine to various operating conditions of the engine simply by modifying the coefficients of the linear combination.

The present invention also provides a device for implementing this process, which includes a) means for outputting a first signal representing the speed error E and a second signal representing the derivative E' of this error, derived from a signal output by a sensor of the actual speed N of the engine and from a signal representing a predetermined value of the set-point deceleration speed $N_c$ and b) a controller supplied with these first and second signals which draws a correction value $\Delta u$ for the control of the actuator from these first and second signals, and means for storing specific values of this correction $\Delta u$ as a function of the deviation between the actual state (E, E') of the engine as known by means of these signals and the locus of the ideal states of this engine.

Other characteristics and advantages of the present invention will become apparent from reading of the description which follows and from examination of the appended drawing, in which:

FIG. 1 is a diagram of an engine equipped with the electronic control means necessary to the implementation of the present invention;

FIGS. 2*a* and 2*b* are graphs which are useful to the description of the process according to the present invention;

FIGS. 4–7 are correction tables which may be used in the process according to the invention;

Figure 1:
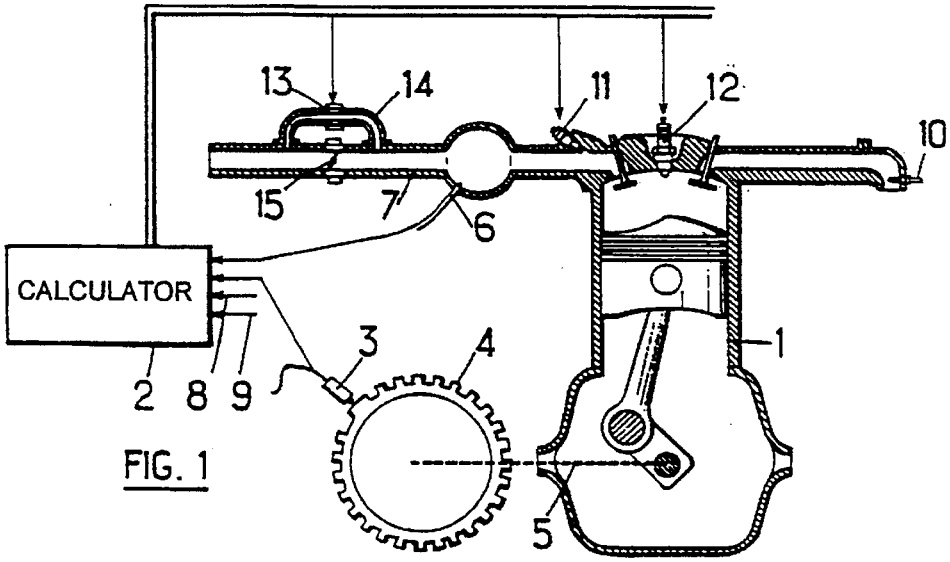

Refer to FIG. 1, which represents a cylinder 1 of an internal combustion engine which propels an automobile, in a standard environment of sensors, actuators and electronic means for controlling these actuators. Thus, an electronic computer 2 is supplied by a sensor 3, for example with variable reluctance, coupled with a gear wheel 4 mounted on the output shaft 5 of the engine, which sends the computer a signal representing the revs (or speed) of the engine, and a pressure sensor 6 mounted inside the intake manifold 7 of the engine provides the computer with a signal representing the pressure of the air admitted into the engine. Other signals 8, 9, etc., which originate from engine coolant temperature sensors, air temperature sensors, etc. or from an oxygen probe 10 placed in the exhaust gases of the engine, can be sent to the computer in the standard way.

This computer is equipped with the hardware and software necessary to the development and emission of signals for controlling actuators such as a fuel injector 11, a spark plug ignition circuit 12 or an additional air control valve 13 placed on a conduit 14 which short-circuits a principal butterfly valve 15 for controlling the quantity of air which enters the engine through the intake manifold 7.

It has been decided that by way of an illustrative and non-limiting example, the control process according to the invention will herein be described in terms of a control of the engine through an action on the opening of the valve 13. However, it will be immediately apparent to one skilled in the art that the same control process could be modeled through an action on the opening time of the injector or on a motorized, electrically driven butterfly valve, or through a combination of actions on these various actuators.

Figure 2A:
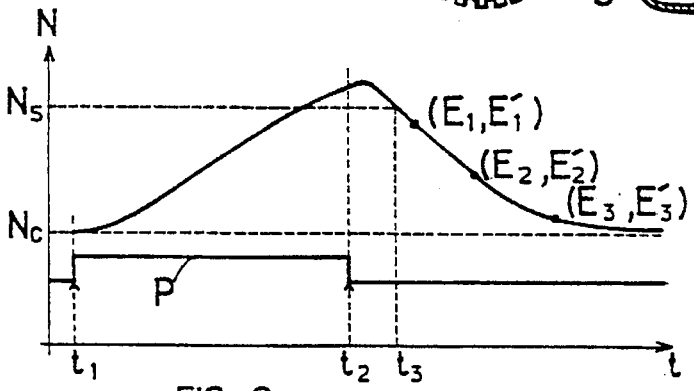

Refer to the graph in FIG. 2*a* which illustrates a standard change in the speed N of the engine at the onset of a deceleration phase. Typically, this onset occurs the moment the following conditions are combined:

on the one hand, the driver has lifted the foot resting on the accelerator, a situation of which the computer 2 is typically informed by a sensor (not shown) which senses that the accelerator pedal (not shown) has reached the top position, the speed N of the engine has fallen below a certain threshold $N_s$ called the "deceleration threshold,"

the vehicle is moving, though this condition is only a possibility, like other conditions which may also be envisaged.

Also shown in FIG. 2*a* is the temporal diagram P of the operation of the accelerator pedal in which, by way of example, the driver has leaned on this pedal at the instant $t_1$ and released the pedal at the instant $t_2$ (the "raised foot" position).

The acceleration which begins at the instant $t_1$ is manifested by an increase in the speed N of the engine, which after the instant $t_2$ is followed by a decrease in this speed due to the "raised foot." With a fixed deceleration threshold, for example $N_s$=1700 rpm, it is observed that the onset of the deceleration phase, under the aforementioned conditions, occurs at the instant $t_3$. After this instant, the state of the engine may be defined, according to the present invention, by the speed error E:

$$E=N_c-N$$

in which $N_c$ is the set-point deceleration speed, and by the time derivative E' of this error E.

In order to avoid "noise" phenomena, this derivative could be replaced by a filtered value of the derivative, for example by a recursive filter of the first order of the type $$\overline{E}'_{(t)}=\overline{E}'_{(t-1)}+k(\overline{E}'_{(t)}-\overline{E}'_{(t-1)}).$$

Thus the engine passes through the states ($E_1$, $E'_1$), ($E_2$, $E'_2$), ($E_3$, $E'_3$), etc., in succession, while the speed N progressively converges on the set-point deceleration speed $N_c$.

In an essential characteristic of the control process according to the present invention, a plurality of states of the engine are established, by measurements on the test bench, for example, in which the value of the error E and that of its derivative have a relationship such that, during a deceleration adjustment phase, when the butterfly valve 15 is closed by the driver's "raised foot," the speed of the engine is able to regain the set point $N_c$ through a monotonous, rapid and smooth variation so as to better provide for comfort in driving the vehicle, without any modification of the nominal adjustment of the opening of the additional air valve 13.

Figure 2B:
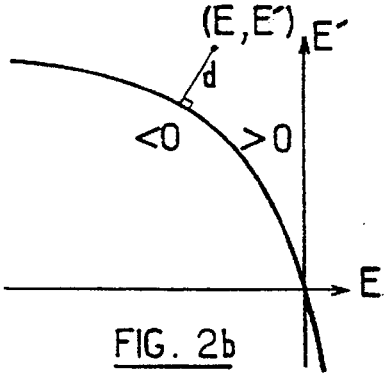

The pairs of values (E, E') thus found are plotted in a coordinate system (E, E'). The graph obtained generally has the appearance shown in FIG. 2*b*. According to the invention, this graph is defined as being the "site" of the "ideal" states of the engine in the deceleration phase—ideal, since they do not require any adjusting action in order to ensure the return to the set-point deceleration speed $N_c$ ($N_c$=700 rpm for example) under optimal conditions for driving comfort.

Thus, if the state of the engine in the deceleration adjustment phase constantly follows this site, no correction is applied to the control of the additional air valve 13 since an optimal return to the set-point speed is assured.

On the contrary, if at a given instant the computer discovers a deviation between the actual state (E, E') of the engine and the nearest point of the site, the computer determines a correction for the control of the additional air valve 13 which is as strong as this deviation is large, so as to return this state to or toward the ideal locus as rapidly and smoothly as possible.

Thus, if the actual state (E, E') of the engine is above the site, the computer sends a command to the valve to increase the size of its opening, and thus the quantity of air admitted, which in turn consequently commands, again by means of the computer, a correlative increase in the quantity of fuel injected, resulting in an increase in the torque produced by the engine and therefore a slower decrease in its speed, in order to bring the engine nearer to the ideal site. The amplitude of the correction is as strong as the distance d separating the actual state (E, E') of the engine from the locus (see FIG. 2*b*) is large.

Conversely, if the actual state (E, E') of the engine is situated below the site, the computer orders a decrease in the opening of the valve 13.

These control principles can be formalized in a table like that shown in FIG. 4, which allows a simple, flexible implementation of the process according to the invention. In order to construct this table, specific points are chosen within the variation ranges of the speed error E and the derivative E' of this error, labelled (NTG–PM) and (PTG–NM) respectively, which points are selectively distributed within these ranges and constitute the two inputs of the table. The corresponding correction value, ascertained on the test bench, for example, is entered at the intersection of each pair of specific values E, E', in order to optimize the control of the engine in the deceleration phase according to the principles outlined above. These correction values are quantified and labelled with the symbols NTG–PTG, by way of analogy with the terminology used in fuzzy logic, an analogy which, moreover, ends there. Thus, the symbols used for the inputs E, E' in the table and for the correction Δu for the control drawn from the table quantify specific values, denoted as follows:

PTG: positive very large
PG: positive large
PM: positive medium
PP: positive small
ZE: zero
NP: negative small
NM: negative medium
NG: negative large
NTG: negative very large It is clear that the real values associated with each of these symbols are different for each of the input variables E,E' and output variables Δu. Among these values, Δu is calculated by interpolation between specific values which appear in the table.

In the table in FIG. 4, a diagonal series of cases "ZE", which define null corrections of the control, will be noted. It is clear that this series of cases corresponds to the "ideal" states defined above, and that the image of the locus in FIG. 2*b* in this table is constituted by the straight line along which these cases are aligned.

It will be noted that, in accordance with the principle revealed above, the correction applied is positive above this line, and negative below it, and that the value of the correction is proportional to the distance which separates a particular case from the straight line of the cases (ZE).

Figure 3:
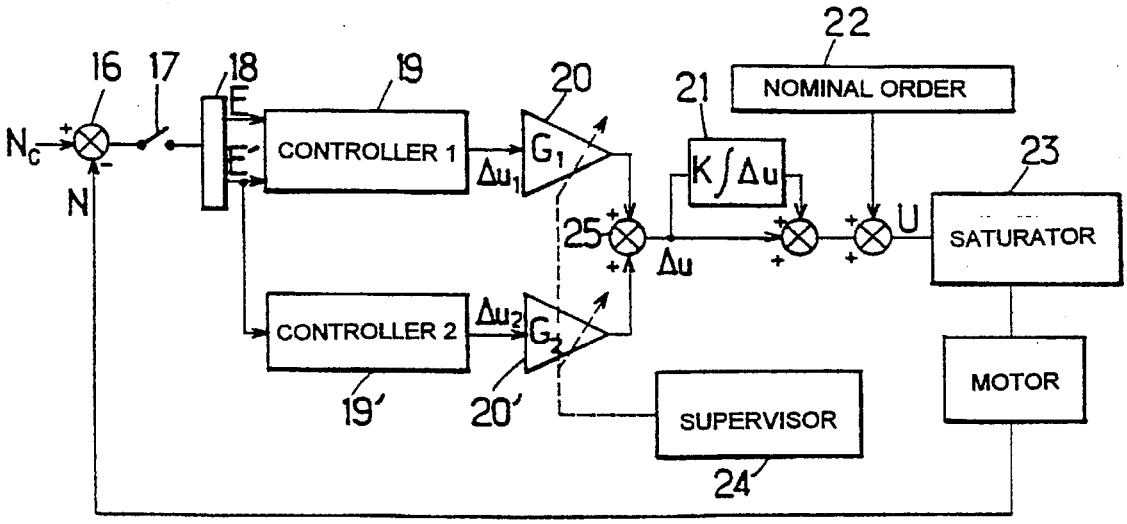
FIG. 3 is a diagram of a preferred embodiment of a device for implementing this process.

The present invention provides a device for implementing the control process described above, a preferred embodiment of which is shown in diagram in FIG. 3. This device is incorporated in the computer 2, which is equipped with the necessary hardware, software, memories, microprocessors, programs, etc., for this purpose. It includes means 16 for formulating the speed error $E=N_c-N$, means 17 for sampling this error at the top dead center of the piston of the cylinder 1, for example as it is running, means 18 for calculating the time derivative or the error and for supplying a "controller" 19 with signals representing the error E and its derivative E'.

From actual or typical values of E and E' and from the table in FIG. 4, the controller 19 emits a correction $\Delta u_1$ of the nominal control 22 of the additional air valve 13, which may possibly be amplified in a amplifier 20 with a gain $G_1$ and added with a component developed by an integrator 21. This integral component is provided in order to correct the nominal control 22 of the additional air control valve 13 in the standard way when this nominal control is no longer suitable due to the application of a continuous or slowly-varying load to the engine, as is the case when a power steering device is operated, for example.

The final control U thus obtained then passes through a saturator 23 which limits the dynamics of the control, which is then finally applied to the valve 13 of the engine.

A device like that described above is sufficient to implement the control process according to the invention when this process is limited to the execution of the controls which appear in the table in FIG. 4.

However, it will be observed that if the onset of a deceleration phase occurs at high values of E and E', for example E=NTG and E'=PTG, the table in FIG. 4 indicates that the correction $\Delta u_1$ of the control of the air valve 13 must be roughly null (ZE). Such a null correction cannot be desirable, since has no effect on the rapid drop in the speed of the engine observed due to the inertia of the vehicle. On the contrary, it is appropriate to slow the drop in the engine speed as soon as it enters the deceleration adjustment phase by making a major correction of the nominal control 22 of the valve 13. In order to do this, according to the invention, the straight line connecting the cases of null correction (ZE), unlike that which appears in the table in FIG. 4, must not be diagonal, so that for example the case which corresponds to E=NTG, that is, E'=PTG, corresponds not to $\Delta u_1$=ZE but to $\Delta u_1$=PTG. For this purpose, it is possible to pivot the straight line of the cases ZE around the line which corresponds to E=ZE and E'=ZE, as shown in FIG. 6. By storing a set of tables like the one in this figure in memory, it is possible to have various degrees of correction available at the onset of the deceleration phase. This solution, however, is costly in terms of memory space.

According to the present invention, this drawback is eliminated by providing a second controller 19' (see FIG. 3) supplied with the derivative E' of the speed error, which outputs a second correction $\Delta u_2$ like that which appears in the table in FIG. 5, to an amplifier 20' with a gain $G_2$, and the two partial corrections $\Delta u_1$ and $\Delta u_2$ output by the controllers 19 and 19', respectively, are combined linearly at 25 to constitute the final control correction Δu, such as:

$$\Delta u = G_1 . \Delta u_1 + G_2 . \Delta u_2$$

Supervising means 24 are provided for controlling the gains $G_1$ and $G_2$ of the amplifiers 20, 21' respectively, for example as a function of the speed of the engine at the onset of the deceleration regulation phase, and possibly as a function of the load carried by the engine, in order to regulate the "slope" of the straight line connecting the cases (ZE) as a function of a given predetermined control strategy, as the examples below will illustrate.

Thus, it is possible to obtain a complete range of tables such as those in FIGS. 6 and 7. The table in FIG. 6 is obtained by adjusting the gains so that $G_1=G_2$, while that in FIG. 7 corresponds to an adjustment of the gains so that $G_1 \ll G_2$, the table in FIG. 5 being preponderant in the combination of the partial corrections $\Delta u_1$ and $\Delta u_2$.

It is clear that the supervising means 24 and the two controllers used make a complete range of correction tables available, while the necessary memory space is advantageously limited to practically that which corresponds to the single tables in FIGS. 4 and 5.

Figures 8, 9:
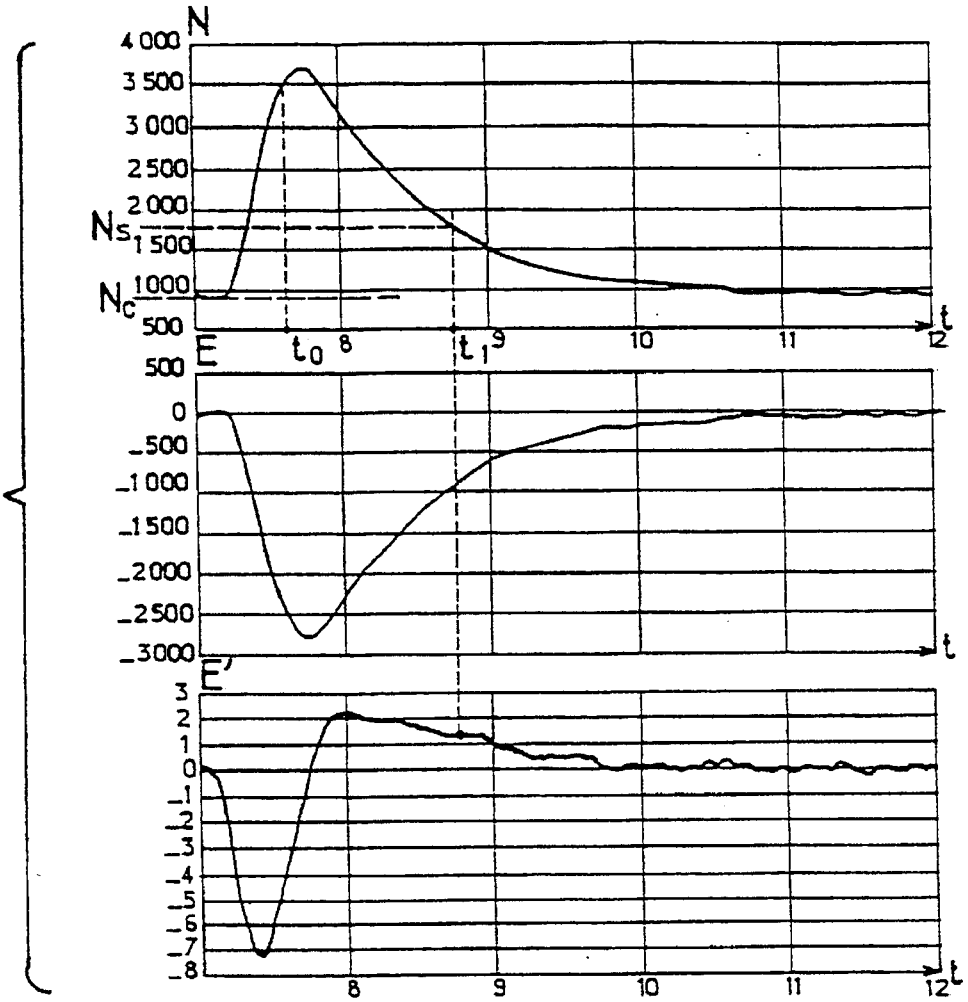
FIG. 8 shows graphs which illustrate the change in speed over time, the speed error and the derivative of this error in an example of the onset of a deceleration phase after a vigorous acceleration.
FIG. 9 is a correction table used in the process according to the invention to ensure the adjustment of the deceleration speed in the situation illustrated by the graphs in FIG. 8.

Refer to FIGS. 8 and 9 which describe, by way of example, an operating mode of the process according to the invention, in a common situation in which the deceleration threshold ($N_s$=1700 rpm, for example) is crossed by higher values at the instant $t_1$, after a "raised foot" at the instant $t_0$, as shown in the graph N(t) in FIG. 8.

In the graphs E(t) and E'(t) in this same figure, it may be seen that at the moment of this crossing, which is assumed to occur in the absence of disturbances, the error E is very large (not far from −1000, coded NTG by an adaptation which is suited to the dynamics of the device), while the derivative is positive and has an average value (coded PM by a similar adaptation).

In the table in FIG. 9, A represents the "trajectory" of the engine under these initial conditions for the onset of the deceleration phase. This table is obtained, as seen above in connection with FIG. 6, by programming the supervising means 24 so as to obtain $G_1$=$G_2$ when the speed at the "raised foot" (instant $t_0$ in FIG. 8) is higher than the deceleration threshold $N_s$. The onset amounts to a control correction of null (ZE) since E=NTG and E'=PM, and the "trajectory" of the engine can then proceed in an optimal manner along the straight line which carries the cases (ZE), again assuming the absence of any disturbance.

In the opposite case, in which for example a disturbance such as the activation of a power steering device occurs, a trajectory like that represented by B in FIG. 9 will be observed. The engagement of the power steering tends to further slow the engine, and the onset of the deceleration phase therefore occurs, for example, with E=NTG and E'=PTG due to the increased slowing of the engine by the load applied to it by the power steering.

In order to slow this excessively rapid decrease in the speed of the engine (which could cause it to stall), it is therefore necessary to increase the torque produced by the engine by increasing the quantity of air delivered through the valve 13, in which case the control of the engine is carried out without a cut-off of the injection during the deceleration phase, since the quantity of fuel injected is adapted by the computer 2 to the quantity of air delivered through the valve 13. If the correction of the control of the valve 13 is the right size, the error E and the derivative E' of the error will decrease along the trajectory B, for successive corrections PG, PM, PP, and ZE.

If the correction of the control of the opening of the air valve is sufficient, then the derivative E' remains at a high value (trajectory C), while the error E, however, decreases, causing an increase in the opening of this valve (the trajectory moves farther away from the straight line of the cases ZE) to the point where the derivative E' has been sufficiently reduced to allow the correction of the control to return toward this straight line of null correction. The controllers 19 and 19' then cooperate to allow the engine to return to the set-point speed under conditions which are good from the point of view of rapidity and driving comfort.

Figures 10, 11, 12:
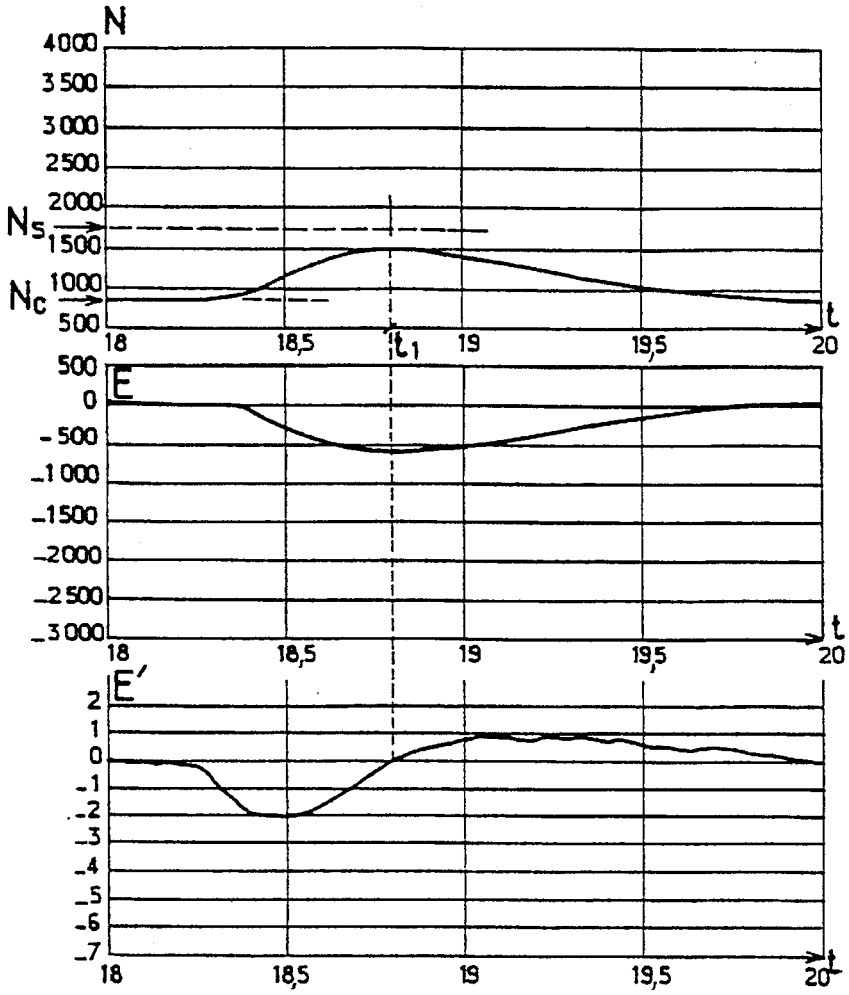
FIG. 10 shows graphs which illustrate the change in speed over time, the speed error and the derivative of this error in an example of the onset of a deceleration phase with a slight acceleration.
FIGS. 11 and 12 show correction tables used in the process according to the invention to ensure the adjustment of the deceleration speed in the situation illustrated in the graphs in FIG. 10.

Refer to FIGS. 10–12 for a description of the operation of the control process according to the invention in another common condition, namely that in which the onset of the deceleration regulation phase occurs at the "raised foot" at the instant $t_1$, while the speed has already fallen below the deceleration threshold $N_s$, as shown in the graph N(t) in FIG. 10.

At the instant $t_1$, the graphs E(t) and E'(t) in FIG. 10 show that the error is relatively large (NG) and the derivative E' of the error is roughly null (ZE). In the table in FIG. 11, which is similar to that in FIG. 9, A labels the "trajectory" of the engine typically observed under the initial conditions. The negative correction (NG) applied initially reduces the torque produced by the engine, which slows it further. Following the trajectory A in the direction of the arrow, it also becomes apparent that the error E becomes positive (E>ZE), meaning that the speed falls below the set point $N_c$, which is unacceptable (risk of the engine stalling).

In order to prevent this risk, the supervisor 24, which is informed of these initial conditions, then reduces the ratio of the gains $G_1/G_2$ in order to rotate the straight line which is the image of the locus of the ideal states of the engine from B to B' (see FIG. 12). Under these conditions, the trajectory A in FIG. 11 takes the form A' shown in FIG. 12. It may be observed that this trajectory then rejoins the straight line which is the image of the ideal states without the speed's falling below the set-point speed and without the risk of the engine stalling.

As seen above, the input data used by the supervisor can include the speed of the engine at the "raised foot," possibly the "load" of the engine, which for example depends on the use of an air conditioner compressor, or even the information which determines whether or not the automobile driven by the engine is in motion.

Thus, for example, when the vehicle is stopped with the engine running, the supervisor adjusts the ratio of the gains $G_1$ and $G_2$ so that, the farther the speed is from the set-point deceleration speed at the "raised foot", the greater the slope of the straight line of the null corrections ZE (see FIG. 6). Likewise, when the vehicle is moving, the supervisor adjusts the ratio of the gains $G_1$ and $G_2$ so that this straight line is nearly horizontal (see FIG. 7).

Between the two situations described above in connection with FIGS. 8 and 9 on the one hand and FIGS. 10–12 on the other hand, all the intermediate situations are possible, and consequently the supervisor 24 adapts the ratio $G_1/G_2$, particularly as a function of the engine speed at the onset of the deceleration regulation phase, as seen above.

When during such a phase the engine continues to drive the vehicle (no action by the driver on the clutch pedal), it is preferable for the control process according to the invention to reduce the effect of the speed error E in order to avoid jerking and vibrations which are detrimental to the comfort and pleasure of driving the vehicle. The supervisor takes this situation into account by reducing the effect of the first controller 19 which senses this error, that is by reducing the ratio $G_1/G_2$ of the gains of the two controllers.

Figure 13:
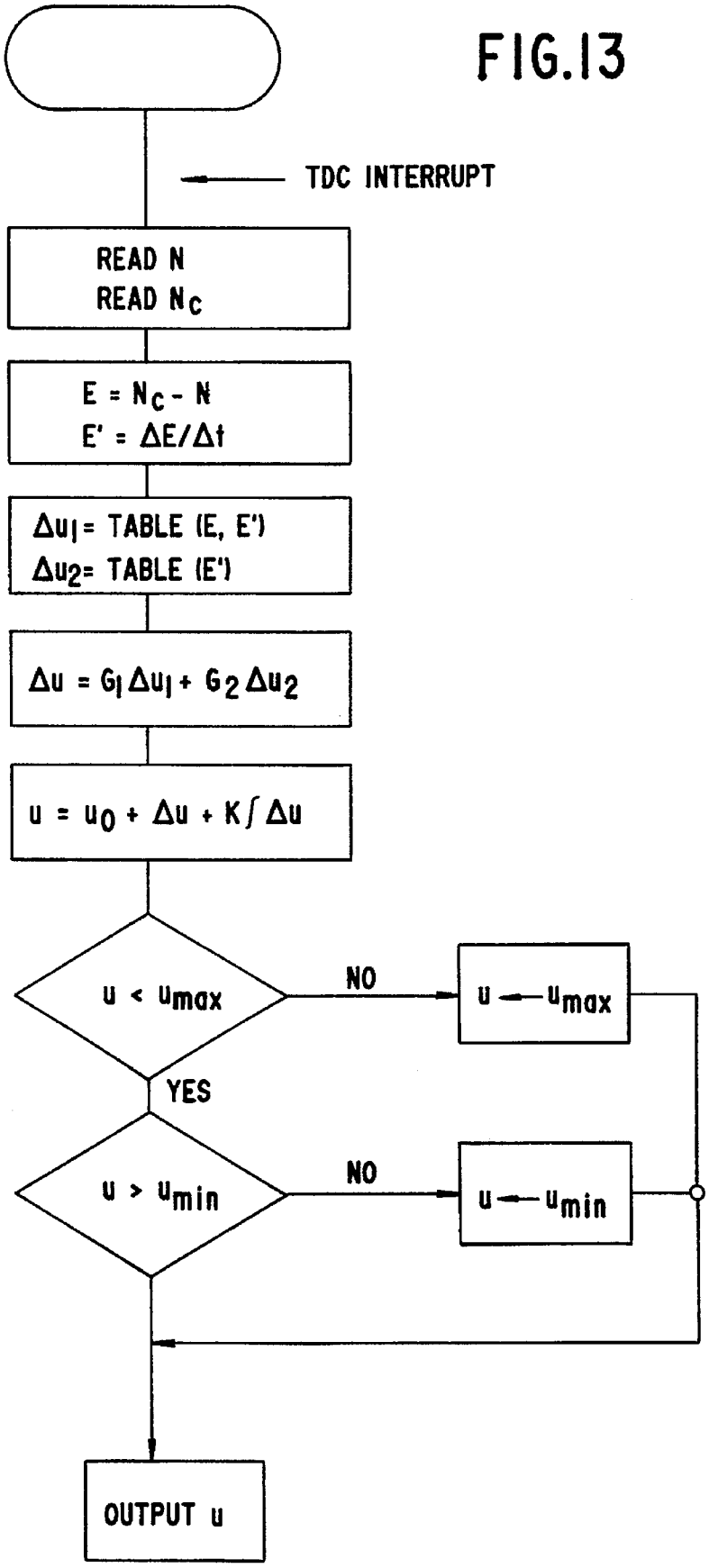
FIG. 13 is a flow chart illustrating the process steps according to the invention.

FIG. 13 is a flow chart depicting the process steps of the assemblies shown in FIGS. 1 and 3.

It is understood that the invention is not limited to the embodiment described and illustrated, which is given only by way of example. Thus, the supervisor 24 may be designed to adjust the ratio of the gains not only as a function of the speed and the load of the engine at the onset of the deceleration regulation speed, but also as a function of other initial conditions such as the temperature of the engine coolant, the air temperature, etc.

We claim:

1. A method of controlling a speed of an internal combustion engine in a deceleration phase, wherein the engine includes a controlled actuator affecting the engine speed, the method which comprises:

determining a setpoint speed of the engine and an error signal as a difference between the setpoint speed and an actual speed of the engine;

defining actual states of the engine as pairs of specific values of the error signal and a time derivative thereof;

defining predetermined ideal states of the engine as pairs of specific values of the error signal and a time derivative thereof which allow the engine to regain the setpoint speed without correcting the actuator control, through a monotonic, rapid, and smooth variation of the speed; and correcting the actuator control as a function of a difference between the actual state and the ideal state of the engine.

2. The method according to claim 1, which comprises drawing a correction value for the actuator control from a first table with the speed error signal as a first input and the time derivative of the speed error signal as a second input.

3. The method according to claim 2, wherein the table contains specific values for the correction of the actuator control, each of which is associated with a pair of specific values of the error signal and of the derivative of the error signal, respectively.

4. The method according to claim 3, wherein the table is defined with a plurality of ideal states of the engine aligned along a straight line.

5. The method according to claim 4, wherein the straight line is defined by rotating a diagonal around a location which corresponds to null values of the error signal and the time derivative thereof.

6. The method according to claim 2, which further comprises establishing a second table with specific values of a partial correction corresponding to specific values of the derivative of the error signal, drawing parallel corrections from the table and from the second table, and correcting the actuator control with a linear combination of the parallel corrections.

7. The method according to claim 6, which comprises performing the linear combination with coefficients being a function of the engine speed at an onset of the deceleration phase.

8. The method according to claim 7, wherein the coefficients are also a function of a load on the engine.

9. A device for controlling a speed of an internal combustion engine in a deceleration phase, wherein the speed is controlled with an actuator as a function of an error signal between a setpoint speed and an actual speed of the engine, the device comprising:

an engine speed control, a sensor connected to said control, said sensor measuring an actual speed of the engine, and said control issuing a first signal representing a speed error signal defined as a difference between a setpoint deceleration speed and an actual speed of the engine, and a second signal representing a time derivative of the speed error signal;

an actuator control and a controller for controlling the engine speed, said controller receiving the first and second signals and defining a correction value for the actuator control from the first and second signals, and a memory for storing specific correction values as a function of a deviation between an actual state of the engine determined from the first and second signals and a location of an ideal state of the engine.

10. The device according to claim 9, wherein said controller is a first controller, and the device further comprises:

a second controller receiving the second signal representing the derivative of the speed error signal of the engine;

said first controller and said second controller outputting first and second partial correction signals for the actuator control, as functions of their respective input signals; and means receiving the partial correction signals for forming a correction signal for the actuator control by linear combination of the partial correction signals.

11. The device according to claim 10, wherein said means for forming the correction signal for the actuator control include amplifiers connected to and receiving the output signals of said first and second controllers, respectively, and including adders for adding output signals of said amplifiers.

12. The device according to claim 11, wherein each of said amplifiers has a given gain, and including supervising means for controlling said gains of said amplifiers in accordance with a predetermined control strategy.

13. The device according to claim 12, wherein said said supervising means receive a signal representing an engine speed at an onset of the deceleration phase.

14. The device according to claim 13, wherein said supervising means receive a signal representing a load on the engine.

15. The device according to claim 9, wherein the engine includes an additional air-control valve, a fuel injector, and a motorized butterfly valve, and a parameter controlled by said actuator is selected from the group consisting of: the opening of the additional air-control valve, the opening time of the fuel injector, the control of the motorized butterfly valve.

* * * * *

UNITED STATES PATENT AND TRADEMARK OFFICE

CERTIFICATE OF CORRECTION

PATENT NO. : 5,642,707

DATED : July 1, 1997

INVENTOR(S) : Patrice Cerf et al

It is certified that error appears in the above-identified patent and that said Letters Patent is hereby corrected as shown below:

On the title page: Item [86] should read as follows:

--PCT/EP94/02155 --.

Signed and Sealed this

Sixth Day of January, 1998

*Attest:*

Bruce Lehman

BRUCE LEHMAN

*Attesting Officer*

*Commissioner of Patents and Trademarks*